US012422140B2

(12) United States Patent
Sukumar et al.

(10) Patent No.: US 12,422,140 B2
(45) **Date of Patent: *Sep. 23, 2025**

(54) COMBUSTOR DEFLECTOR ASSEMBLY

(71) Applicant: General Electric Company, Schenectady, NY (US)

(72) Inventors: Vijayaraj Sukumar, Bengaluru (IN); Perumallu Vukanti, Bengaluru (IN); Pradeep Naik, Bengaluru (IN); Ajoy Patra, Bengaluru (IN); Karthikeyan Sampath, Bengaluru (IN); Rimple Rangrej, Bengaluru (IN); Hiranya Nath, Bengaluru (IN); Krishnendu Chakraborty, Bengaluru (IN); Narasimhan S. Sahana, Bengaluru (IN); Saket Singh, Bengaluru (IN); Ravindra Shankar Ganiger, Bengaluru (IN)

(73) Assignee: GENERAL ELECTRIC COMPANY, Evendale, OH (US)

( * ) Notice: Subject to any disclaimer, the term of this patent is extended or adjusted under 35 U.S.C. 154(b) by 0 days.

This patent is subject to a terminal disclaimer.

(21) Appl. No.: 18/598,467

(22) Filed: Mar. 7, 2024

(65) Prior Publication Data

US 2024/0247802 A1 Jul. 25, 2024

Related U.S. Application Data

(63) Continuation of application No. 17/812,897, filed on Jul. 15, 2022, now Pat. No. 11,927,349.

(30) Foreign Application Priority Data

Apr. 6, 2022 (IN) ..... 202211020649

(51) Int. Cl.
*F23R 3/00* (2006.01)
*F23R 3/60* (2006.01)
(Continued)

(52) U.S. Cl.
CPC ..... *F23R 3/002* (2013.01); *F23R 3/60* (2013.01); *F23R 3/04* (2013.01); *F23R 3/10* (2013.01);
(Continued)

(58) Field of Classification Search
CPC .. F23R 2900/00017; F23R 2900/03045; F23R 3/002; F23R 3/04; F23R 3/10; F23R 3/60
See application file for complete search history.

(56) References Cited

U.S. PATENT DOCUMENTS 4,380,905 A * 4/1983 Smart ..... F23R 3/002 60/756
4,820,097 A 4/1989 Maeda et al.
(Continued)

FOREIGN PATENT DOCUMENTS

DE 10325599 B4 5/2014
EP 3086041 B1 7/2021
(Continued)

OTHER PUBLICATIONS

Final Report on Incident to M/S/ Indigo Airlines Airbus A320 Aircraft VT-ITF AT Mumbai on Jan. 21, 2017, Jan. 3, 2019, 39 pages.

*Primary Examiner* — Jesse S Bogue
(74) *Attorney, Agent, or Firm* — Venable LLP; Peter T. Hrubiec; Michele V. Frank

(57) ABSTRACT

A deflector assembly for a combustor defining an operational fluid flow. The deflector assembly includes an upstream surface and a downstream surface opposite the upstream surface. One or more fastening mechanisms each
(Continued)

extends through the deflector assembly. One or more cooling holes extend through the deflector assembly from the upstream surface to the downstream surface. The one or more cooling holes are located about the one or more fastening mechanisms to operably direct cooling air about the one or more fastening mechanisms at the downstream surface.

20 Claims, 7 Drawing Sheets

(51) Int. Cl.
*F23R 3/04* (2006.01)
*F23R 3/10* (2006.01)

(52) U.S. Cl.
CPC ..... *F23R 2900/00017* (2013.01); *F23R 2900/03045* (2013.01)

(56) References Cited

U.S. PATENT DOCUMENTS 5,129,231 A * 7/1992 Becker ..... F23R 3/14 60/754
5,271,219 A * 12/1993 Richardson ..... F23R 3/10 60/804
5,419,115 A * 5/1995 Butler ..... F23R 3/283 60/740
6,718,774 B2 4/2004 Razzell
6,941,758 B2 9/2005 Tiemann
6,978,618 B2 * 12/2005 Pacheco-Tougas ..... F23R 3/002 60/754
7,509,813 B2 * 3/2009 Stastny ..... F23R 3/50 60/752
7,681,398 B2 * 3/2010 Patel ..... F02C 3/145 60/752
8,418,470 B2 4/2013 Burd
9,010,122 B2 * 4/2015 Bangerter ..... F23R 3/002 60/754
9,322,560 B2 4/2016 Erbas-Sen et al.
9,377,198 B2 6/2016 Eastwood et al.
9,534,786 B2 1/2017 Sreekanth et al.
9,746,184 B2 * 8/2017 Papple ..... F23R 3/10
9,964,307 B2 5/2018 Sullivan
9,982,890 B2 * 5/2018 Papple ..... F23R 3/002
10,222,066 B2 3/2019 Chen et al.
10,422,532 B2 9/2019 Sadil et al.
10,488,046 B2 * 11/2019 Low ..... F23R 3/50
10,533,747 B2 1/2020 Corsmeier et al.
10,619,857 B2 4/2020 Lemoine et al.
10,670,273 B2 6/2020 Propheter-Hinckley et al.
10,670,275 B2 6/2020 Propheter-Hinckley et al.
10,690,346 B2 6/2020 Propheter-Hinckley et al.
12,025,315 B2 * 7/2024 Chiranthan ..... F23R 3/002
2016/0313005 A1 * 10/2016 Chang ..... B23K 15/0086
2018/0292089 A1 10/2018 Porter et al.
2021/0254475 A1 8/2021 Dyson et al.
2024/0053009 A1 * 2/2024 Ganiger ..... F02C 7/00

FOREIGN PATENT DOCUMENTS

EP 3453968 B1 10/2021
KR 101529816 B1 6/2015

* cited by examiner

COMBUSTOR DEFLECTOR ASSEMBLY

CROSS REFERENCE TO RELATED APPLICATIONS

This application is a continuation of U.S. patent application Ser. No. 17/812,897 filed on Jul. 15, 2022, which claims priority to Indian patent application Ser. No. 202211020649, filed on Apr. 6, 2022, the entire contents of which are hereby incorporated by reference in their entireties.

TECHNICAL FIELD

The present disclosure relates to a combustor deflector assembly.

BACKGROUND

A gas turbine engine may include a combustion section having a combustor that generates hot combustion gases discharged into a turbine section of the engine. The combustor section may include a deflector assembly to shield portions of the combustor section from the hot combustion gases. The deflector assembly may include a cooling arrangement to cool portions of the deflector assembly.

BRIEF DESCRIPTION OF THE DRAWINGS

Features and advantages of the present disclosure will be apparent from the following description of various exemplary embodiments, as illustrated in the accompanying drawings, wherein like reference numbers generally indicate identical, functionally similar, or structurally similar elements.

DETAILED DESCRIPTION

Figure 1:
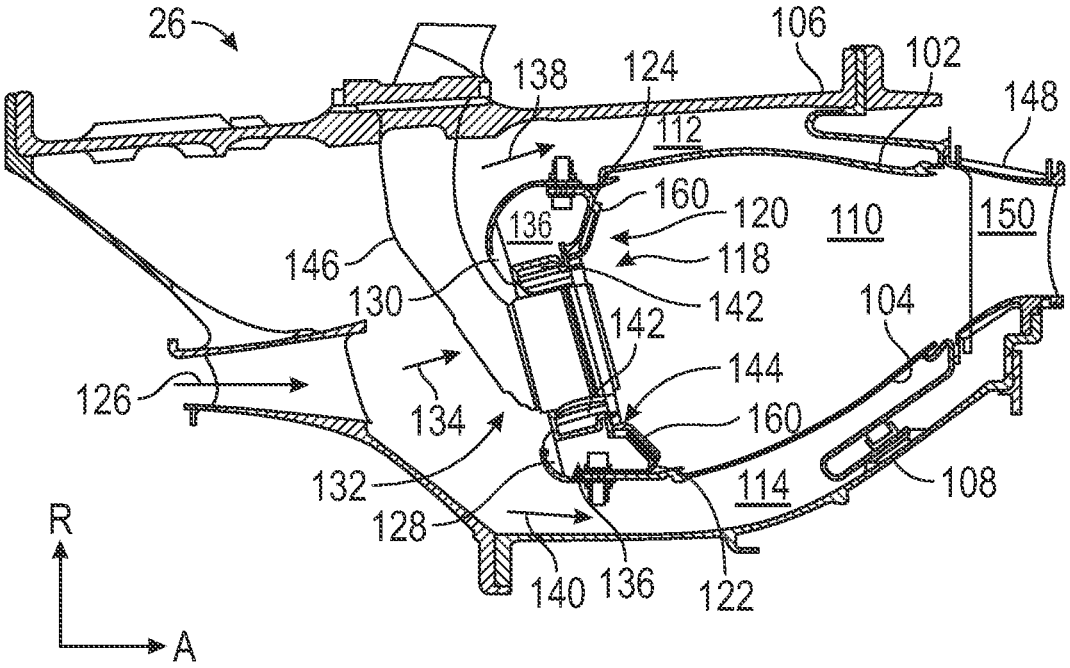
FIG. 1 is a schematic partial cross-sectional view of a portion of an exemplary combustor section having a deflector assembly used in a gas turbine engine system, according to an aspect of the present disclosure.

Features, advantages, and embodiments of the present disclosure are set forth or apparent from a consideration of the following detailed description, drawings, and claims. Moreover, it is to be understood that the following detailed description is exemplary and intended to provide further explanation without limiting the scope of the disclosure as claimed.

Various embodiments are discussed in detail below. While specific embodiments are discussed, this is done for illustration purposes only. A person skilled in the relevant art will recognize that other components and configurations may be used without departing from the spirit and the scope of the present disclosure.

As used herein, the terms "first," "second," and "third" may be used interchangeably to distinguish one component from another and are not intended to signify location or importance of the individual components.

The terms "upstream" and "downstream" refer to the relative direction with respect to fluid flow in a fluid pathway. For example, "upstream" refers to the direction from which the fluid flows, and "downstream" refers to the direction to which the fluid flows.

The terms "coupled," "fixed," "attached," "connected," and the like, refer to both direct coupling, fixing, attaching, or connecting as well as indirect coupling, fixing, attaching, or connecting through one or more intermediate components or features, unless otherwise specified herein.

The singular forms "a," "an," and "the" include plural references unless the context clearly dictates otherwise.

Approximating language, as used herein throughout the specification and claims, is applied to modify any quantitative representation that could permissibly vary without resulting in a change in the basic function to which it is related. Accordingly, a value modified by a term or terms, such as "about," "approximately," "generally," and "substantially" is not to be limited to the precise value specified. In at least some instances, the approximating language may correspond to the precision of an instrument for measuring the value, or the precision of the methods or machines for constructing or manufacturing the components or systems. For example, the approximating language may refer to being within a one, two, four, ten, fifteen, or twenty percent margin in either individual values, range(s) of values or endpoints defining range(s) of values.

The deflector assembly of the present disclosure may include a bolted arrangement of one or more bolts positioned around the deflector assembly. The deflector assembly may be attached or otherwise mounted to a dome of a combustor in an aircraft engine, via the bolted arrangement using the one or more bolts. When the deflector assembly and the dome are assembled, a head portion of the bolts may be exposed to the hot combustion gases. Accordingly, the bolted arrangement of some deflector assemblies may experience thermal distress around the bolts due to the proximity of the head portions to the hot combustion gases. In some instances, the thermal distress around the bolts may cause fatigue, failure, or wear to a portion of the deflector assembly around a bolt region. Thus, embodiments of the present disclosure provide for an improved cooling arrangement around the bolts of the deflector assembly to improve durability and life cycle of such deflector assemblies as compared to deflector assemblies without the benefit of the present disclosure.

Embodiments of the present disclosure may provide for cooling on both a cold side and a hot side of the deflector assembly around the bolts. The deflector assembly may include one or more cooling holes to operably direct cooling air radially or tangentially to the head of the bolt on the hot side of the deflector assembly. For example, the cooling holes may be angled radially inward to direct cooling air radially towards the head of the bolt. The cooling air may act as a "curtain" of air such that a cool insulating layer of air is provided about the bolts to reduce or to prevent heat transfer of the hot combustion gases to the bolts. Pins or ribs on the cold side of the deflector assembly provide structural support of the deflector assembly when mounted to the dome. The pins or the ribs may facilitate turbulence of cooling air around the pins and provide greater surface area for heat transfer to improve cooling. The cooling arrangement of the present disclosure may include retracted bolts with surrounding cooling patterns to reduce thermal distress on the bolt head due to the combustion gases during aircraft engine operation. For example, the deflector assembly may include recessed areas in which the bolts are inserted or otherwise extended therefrom. In this sense, the bolts may be recessed from the hot side of the deflector assembly. In some examples, the cooling holes are located on the recessed areas of the deflector assembly. The cooling holes may be angled to operably direct cooling air tangentially to the head of the bolt on the hot side of the deflector assembly.

The bolts may include cooling holes therethrough such that cooling air may flow through the bolts to further reduce thermal distress around the bolt head. The pins may be disposed on the deflector assembly around the bolts in various patterns to enable increased residence time of the cooling air in an area of the pins. The pins may include a bored aperture through a center of the pins to supply substantially axial cooling flow around the bolts. For example, the axial cooling flow may act as an additional curtain of air such that a cool insulating layer of air is operably directed around the bolts to reduce or to prevent heat transfer of the hot combustion gases to the bolts. The pins may be shaped and sized to enable effective heat dissipation. Further, semi-circular slits may be provided on the deflector assembly between the bolts and a fuel/air swirler to provide a curtain of air in the deflector assembly to further shield the bolts from hot combustion gases.

Accordingly, technical effect of the cooling arrangement of the present disclosure may promote heat dissipation and reduce thermal distress around the bolts of the deflector assembly. Thus, the cooling arrangement of the present disclosure may increase durability and life cycle of the deflector assembly compared to cooling arrangements for such deflector assemblies without the benefit of the present disclosure.

Referring now to the drawings, FIG. 1 is a schematic partial cross-sectional view of a portion of an exemplary combustion section 26 having a deflector assembly 160 used in a gas turbine engine system, as may incorporate various embodiments of the present disclosure. Gas turbine engine systems may include any suitable configuration, such as, but not limited to, turbofan, turboprop, turboshaft, turbojet, or prop-fan configurations for aviation, marine, or power generation purposes. Still further, other suitable configurations may include steam turbine engines or other Brayton cycle machine. Various embodiments of the combustion section 26 may further define a rich burn combustor in particular. Other embodiments may however, define a lean burn combustor configuration. In the exemplary embodiment, the combustion section 26 includes an annular combustor. One skilled in the art will appreciate that the combustor may be any other combustor, including, but not limited to, a single or a double annular combustor, a can-combustor, or a can-annular combustor.

As shown in FIG. 1, the combustion section 26 defines an axial direction A and a radial direction R that is normal to the axial direction A. The combustion section 26 includes an outer liner 102 and an inner liner 104 disposed between an outer combustor casing 106 and an inner combustor casing 108. The outer liner 102 and the inner liner 104 are spaced radially from each other such that a combustion chamber 110 is defined therebetween. The outer liner 102 and the outer combustor casing 106 form an outer passage 112 therebetween, and the inner liner 104 and the inner combustor casing 108 form an inner passage 114 therebetween.

The combustion section 26 may also include a combustor assembly 118 comprising an annular dome assembly 120 mounted upstream of the combustion chamber 110. The combustor assembly 118 is configured to be coupled to the forward ends of the outer liner 102 and the inner liner 104. More particularly, the combustor assembly 118 includes an inner annular dome 122 attached to the forward end of the inner liner 104 and an outer annular dome 124 attached to the forward end of the outer liner 102.

The combustion section 26 may be configured to receive an annular stream of compressor discharge air 126 from a discharge outlet of a high pressure compressor (not shown) of the gas turbine engine system. To assist in directing the compressed air, the annular dome assembly 120 may further comprise an inner cowl 128 and an outer cowl 130 that may be coupled to the upstream ends of the inner liner 104 and the outer liner 102, respectively. In this regard, an annular opening 132 formed between the inner cowl 128 and the outer cowl 130 enables compressed fluid to enter combustion section 26 through a diffuse opening in a direction generally indicated by flow direction 134. The compressed air may enter into a cavity 136 defined at least in part by the annular dome assembly 120. In various embodiments, the cavity 136 is more specifically defined between the inner annular dome 122 and the outer annular dome 124, and the inner cowl 128 and the outer cowl 130. As will be discussed in more detail below, a portion of the compressed air in the cavity 136 may be used for combustion, while another portion may be used for cooling the combustion section 26.

In addition to directing air into the cavity 136 and the combustion chamber 110, the inner cowl 128 and the outer cowl 130 may direct a portion of the compressed air around the outside of the combustion chamber 110 to facilitate cooling the outer liner 102 and the inner liner 104. For example, as shown in FIG. 1, a portion of the compressor discharge air 126 may flow around the combustion chamber 110, as indicated by outer passage flow direction 138 and inner passage flow direction 140, to provide cooling air to the outer passage 112 and the inner passage 114, respectively.

In certain exemplary embodiments, the inner annular dome 122 may be formed integrally as a single annular component, and, similarly, the outer annular dome 124 may also be formed integrally as a single annular component. In still certain embodiments, the inner annular dome 122 and the outer annular dome 124 may together be formed as a single integral component. In still various embodiments, the annular dome assembly 120, including one or more of the inner annular dome 122, the outer annular dome 124, the outer liner 102, or the inner liner 104, may be formed as a single integral component. In other exemplary embodiments, the inner annular dome 122 or the outer annular dome 124 may alternatively be formed by one or more components joined in any suitable manner. For example, with reference to the outer annular dome 124, in certain exemplary embodiments, the outer cowl 130 may be formed separately from the outer annular dome 124 and attached to the forward end of the outer annular dome 124 using, e.g., a welding process, a mechanical fastener, a bonding process or adhesive, or a composite layup process. Additionally, or alternatively, the inner annular dome 122 may have a similar configuration.

The combustor assembly 118 further includes a plurality of mixer assemblies 142 spaced along a circumferential direction between the outer annular dome 124 and the inner annular dome 122. In this regard, the annular dome assembly 120 defines an opening in which a swirler, a cyclone, or a mixer assembly 142 is mounted, attached, or otherwise integrated for introducing the air/fuel mixture into the combustion chamber 110. Notably, compressed air may be directed from the combustion section 26 into or through one or more of the mixer assemblies 142 to support combustion in the upstream end of the combustion chamber 110.

A liquid or a gaseous fuel is transported to the combustion section 26 by a fuel distribution system (not shown), where it is introduced at the front end of a burner in a highly atomized spray from a fuel nozzle. In an exemplary embodiment, each mixer assembly 142 may define an opening for receiving a fuel injector 146 (details are omitted for clarity). The fuel injector 146 may inject fuel in a generally axial direction A, as well as in a generally radial direction R, where the fuel may be swirled with the incoming compressed air. Thus, each mixer assembly 142 receives compressed air from the annular opening 132 and fuel from a corresponding fuel injector 146. Fuel and pressurized air are swirled and mixed together by the mixer assemblies 142, and the resulting fuel/air mixture is discharged into combustion chamber 110 for combustion thereof.

The combustion section 26 may further comprise an ignition assembly (e.g., one or more igniters extending through the outer liner 102) suitable for igniting the fuel-air mixture. Details of the fuel injectors and ignition assembly are omitted in FIG. 1 for clarity. Upon ignition, the resulting hot combustion gases may flow in a generally axial direction A through the combustion chamber 110 into and through the turbine section of the engine where a portion of thermal or kinetic energy from the hot combustion gases is extracted via sequential stages of turbine stator vanes and turbine rotor blades. More specifically, the hot combustion gases may flow into an annular, first stage turbine nozzle 148. As is generally understood, the first stage turbine nozzle 148 may be defined by an annular flow channel that includes a plurality of radially extending, circularly spaced nozzle vanes 150 that turn the gases so that they flow angularly and impinge upon the first stage turbine blades (not shown) of a high pressure turbine (not shown) of the gas turbine engine system.

Referring still to FIG. 1, the plurality of mixer assemblies 142 are placed circumferentially within the annular dome assembly 120. Fuel injectors 146 are disposed in each mixer assembly 142 to provide fuel and to support the combustion process.

Each dome has a heat shield, for example, a deflector assembly 160, which thermally insulates the annular dome assembly 120 from the extremely high temperatures generated in the combustion chamber 110 during engine operation (e.g., from the hot combustion gases). The inner annular dome 122, the outer annular dome 124, and the deflector assembly 160 may define a plurality of openings 144 for receiving the mixer assemblies 142. As shown, the plurality of openings 144 are, in one embodiment, circular. In other embodiments, the openings 144 are ovular, elliptical, polygonal, oblong, or other non-circular cross sections. The deflector assembly 160 is mounted on a combustion chamber side (e.g., a downstream side) of the annular dome assembly 120. The deflector assembly 160 may include a plurality of panels 200 (one of which is shown in FIG. 2A), as detailed further below.

Compressed air (e.g., compressor discharge air 126) flows into the annular opening 132 where a portion of the compressor discharge air 126 will be used to mix with fuel for combustion and another portion will be used for cooling the deflector assembly 160. Compressed air may flow around the fuel injector 146 and through the mixing vanes around the circumference of the mixer assemblies 142, where compressed air is mixed with fuel and directed into the combustion chamber 110. Another portion of the air enters into a cavity 136 defined by the annular dome assembly 120, the inner cowl 128, and the outer cowl 130. The compressed air in the cavity 136 is used, at least in part, to cool the annular dome assembly 120 and the deflector assembly 160, as detailed further below.

Figure 2A:
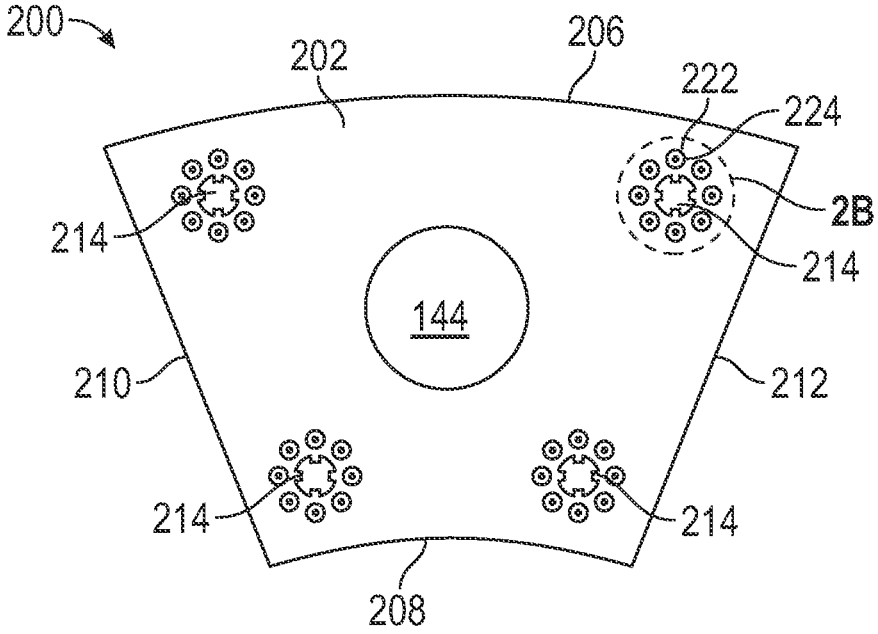
FIG. 2A is a front view of an upstream surface of an exemplary panel of the deflector assembly of FIG. 1, according to an aspect of the present disclosure.

FIG. 2A is a front view of a first upstream surface 202 of an exemplary panel 200 of the deflector assembly 160. As shown in FIG. 2A, each panel 200 includes the first upstream surface 202 and a first downstream surface 204 (shown in FIG. 2C) opposite of the first upstream surface 202. Each panel 200 may also include a circumferential outer side 206 and a circumferential inner side 208 that define a predetermined arc with regard to the circumference of the panel 200. Each panel 200 may include a first radially extending side 210 and a second radially extending side 212 that each extends from the circumferential outer side 206 to the circumferential inner side 208. Each panel 200 further includes an opening 144 that extends between the first upstream surface 202 and the first downstream surface 204 for receiving a respective one of the mixer assemblies 142, as detailed above.

The plurality of panels 200 may together form different segments or sections of the deflector assembly 160. For example, each panel 200 of the plurality of panels 200 may be configured together to form an annulus or a similar annular structure defining the deflector assembly 160. In some embodiments, each panel 200 of the plurality of panels 200 may be formed of a separate component and each panel 200 (e.g., each separate component) may be attached or otherwise connected together to form the deflector assembly 160. In some embodiments, the plurality of panels 200 may be formed of a singular or a unitary structure that defines the annulus or the annular structure of the deflector assembly 160. The shape or the size of the plurality of panels 200, and, thus, the shape or the size of the deflector assembly 160, may include any shape or any size, as necessary, for providing thermal insulation for the annular dome assembly 120.

Each panel 200 includes one or more fastening mechanisms 214 for fastening each panel 200, and, thus, the deflector assembly 160, to the annular dome assembly 120. The one or more fastening mechanisms 214 may include any type of fastening mechanism, such as, for example, studs, threaded bolts, screws, nuts, rivets, or the like. While four fastening mechanisms 214 are shown on panel 200 in the exemplary embodiment, each panel 200 may include any number of fastening mechanisms 214, as desired. The one or more fastening mechanisms 214 may each be located at, near, or adjacent a respective corner, edge, perimeter, or the like, of a respective panel 200. One or more fastening mechanisms 214 may be located anywhere along a circumferential or a radial direction of a respective panel 200, as desired.

Each panel 200 includes one or more pins 222 (only one of which is labeled in each respective figure) associated with each fastening mechanism 214. The one or more pins 222 may provide greater surface area for heat transfer to improve cooling of each panel 200 about the one or more fastening mechanisms 214, as detailed further below. The one or more pins 222 may also facilitate turbulence of a flow of cooling air. For example, the one or more pins 222 may disrupt the flow of cooling air such that the flow of cooling air becomes irregular and heat transfer is improved about the one or more pins 222. The one or more pins 222 may also provide additional structural support between the deflector assembly 160 and the annular dome assembly 120 about an area of the fastening mechanisms 214.

In the example of FIG. 2A, the one or more pins 222 may include a generally cylindrical shape and may be arranged in a generally circular pattern about a respective fastening mechanism 214. The one or more pins 222 may include other shapes or sizes and may be arranged in other patterns, as detailed further below with respect to FIGS. 9 to 12. The one or more pins 222 may each include one or more cooling holes 224 (only one of which is labeled in each respective figure) extending therethrough. For example, the one or more cooling holes 224 may extend axially through each of the one or more pins 222, as detailed further below.

Figure 2B:
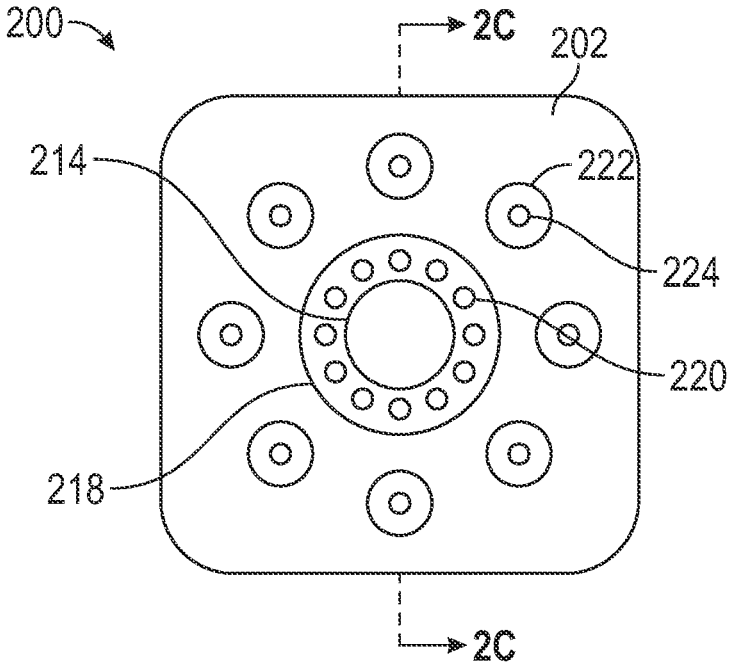
FIG. 2B is an enlarged front view, taken at detail 2B in FIG. 2A, of a portion of the exemplary panel about an area of a fastening mechanism, according to an aspect of the present disclosure.

FIG. 2B is an enlarged front view, taken at detail 2B in FIG. 2A, of a portion of the exemplary panel 200 about an area of a fastening mechanism 214. As shown in FIG. 2B, each panel 200 includes a recessed portion 218 in an area surrounding each of the one or more fastening mechanisms 214. The recessed portion 218 includes a portion of a respective panel 200 that is recessed with respect to the first downstream surface 204, as detailed further below with respect to FIG. 2C. A respective fastening mechanism 214 may be located centrally in the recessed portion 218 such that the respective fastening mechanism 214 is recessed or otherwise retracted with respect to the first downstream surface 204. The respective fastening mechanism 214 may be located anywhere within the recessed portion 218, as desired. Further, while the recessed portion 218 illustrated in FIG. 2B is generally circular in shape, the recessed portion 218 about each fastening mechanism 214 may include any shape or size, as desired. The recessed portion 218 may include one or more cooling holes 220 extending therethrough. The one or more cooling holes 220 may extend from the first upstream surface 202 to the first downstream surface 204 of the recessed portion 218, as detailed further below.

Figure 2C:
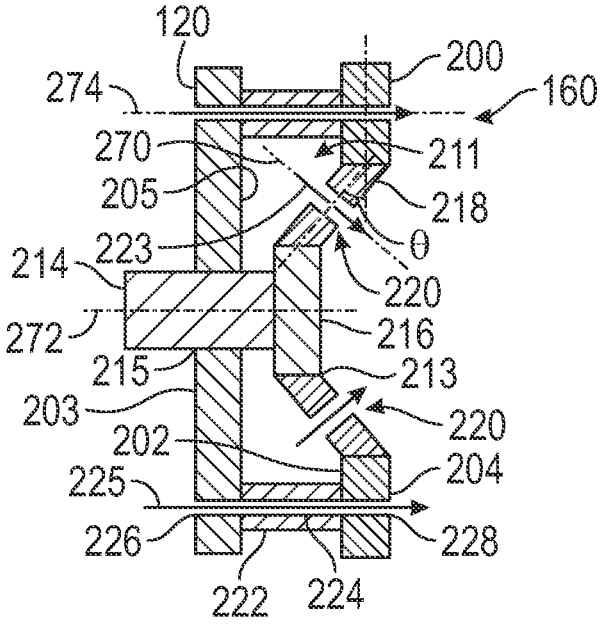
FIG. 2C is a schematic cross-sectional view, taken at detail 2C in FIG. 2B, of a portion of the exemplary panel, according to an aspect of the present disclosure.

FIG. 2C is a schematic cross-sectional view, taken at detail 2C in FIG. 2B, of a portion of an exemplary panel 200. As shown in FIG. 2C, a cavity 211 may be defined between the annular dome assembly 120 and the deflector assembly 160 when the plurality of panels 200 are mounted or otherwise attached to the annular dome assembly 120. The one or more fastening mechanisms 214 may be inserted through respective central holes 213 (one central hole 213 is shown in FIG. 2C) of each panel 200. Each central hole 213 may be located at a central area of the recessed portion 218 such that a respective fastening mechanism 214 is located centrally within the recessed portion 218, as detailed above. The one or more fastening mechanisms 214 may project or otherwise extend from the first upstream surface 202 of a respective panel 200 and may be inserted into respective holes 215 (one hole 215 is shown in FIG. 2C) or other mounting structures of the annular dome assembly 120. In some embodiments, the one or more fastening mechanisms 214 may be formed integral with a respective panel 200 such that central holes 213 may not be necessary.

When the one or more fastening mechanisms 214 are disposed on or through a panel 200, a head 216 of a respective fastening mechanism 214 may be disposed at, near, or adjacent the first downstream surface 204 of the recessed portion 218 of a respective panel 200. In FIG. 2C, the head 216 of each of the one or more fastening mechanisms 214 is disposed flush with the first downstream surface 204 of the recessed portion 218 of a respective panel 200. The head 216 of a respective fastening mechanism 214 may however, be axially recessed with respect to the first downstream surface 204.

During operation of the combustor, the one or more fastening mechanisms 214 may be exposed to hot combustion gases at the first downstream surface 204 of each panel 200. Accordingly, the one or more fastening mechanisms 214 may experience thermal distress due to the hot combustion gases, as detailed above. Embodiments of the present disclosure provide for improved cooling about the one or more fastening mechanisms 214 to reduce a thermal gradient and to improve durability of the deflector assembly 160, as detailed further below.

In FIG. 2C, the recessed portion 218 may recede from the first downstream surface 204 in an axially proximal direction towards the annular dome assembly 120 when a respective panel 200 is mounted to the annular dome assembly 120. For example, the recessed portion 218 may define an angled portion of a respective panel 200 with respect to the first downstream surface 204. For example, the recessed portion 218 may recede from the first downstream surface 204 at an angle (θ) of approximately forty-five degrees (45°) from the first downstream surface 204 for ease of placement and alignment of the cooling holes 220 (e.g., ease of manufacturing) such that the cooling holes 220 to provide an effective "curtain" of cooling air 223 about a respective fastening mechanism 214, as detailed below. The recessed portion 218 may of course, recede from the first downstream surface 204 at any angle (θ) greater than zero degrees (0°) and less than or equal to ninety degrees (90°). In some instances, if the angle (θ) is greater than sixty degrees (60°), sharp edges between the first downstream surface 204 and the recessed portion 218 may be formed and thermal and mechanical stresses at the edges may increase due to the sharp edges. Further, if the angle (θ) is less than thirty degrees (30°), the head 216 of the respective fastening mechanism 214 may be disposed closer to the hot combustion gases resulting in higher thermal stresses on the fastening mechanism 214 as compared to higher angles (θ). Thus, preferably, the angle (θ) may be greater than or equal to thirty degrees (30°) and less than or equal to sixty degrees (60°), relative to the first downstream surface 204. Such a range may provide for a desired range to balance placement of the head 216 of the fastening mechanism 214 away from the hot combustion gases, while reducing or minimizing thermal or mechanical stress at the edges formed between the first downstream surface 204 and the recessed portion 218.

The one or more cooling holes 220 are disposed in the panel 200 in an area about a respective fastening mechanism 214. Each of the one or more cooling holes 220 may include a longitudinal axis 270, relative to each respective cooling hole 220 (shown on only one cooling hole 220 in FIG. 2C for clarity). The longitudinal axis 270 of each of the one or more cooling holes 220 may extend at an axial angle (an angle in an axial direction) with respect to a longitudinal axis 272 of a respective fastening mechanism 214 (shown on only the fastening mechanism 214 of FIG. 2C for clarity). The longitudinal axis 270 of the one or more cooling holes 220 may extend at an axial angle between plus fifteen degrees (+15°) to minus one hundred five degrees (−105°) with respect to the longitudinal axis 272 of a respective fastening mechanism 214. Stated another way, the longitudinal axis 270 of the one or more cooling holes 220 may extend at an angle between plus or minus sixty degrees (±60°) with respect to a normal of the recessed portion 218 (e.g., an axis that is perpendicular the recessed portion 218). Such an axial angle or angle with respect to the normal of the recessed portion 218 provides for ease of manufacturing the one or more cooling holes 220 while providing an effective curtain of cooling air 223 through the one or more cooling holes 220 and about the head 216 of a respective fastening mechanism 214 compared to other or alternative angles. For example, the effective curtain of cooling air 223 provides a cool insulating layer of air about a fastening mechanism 214 to reduce or to prevent heat transfer of the hot combustion gases to the respective fastening mechanism 214. The other or alternative angles of the one or more cooling holes 220 may not provide for an effective curtain of air such that the cooling air 223 through the one or more cooling holes 220 may not entirely reduce or prevent heat transfer of the hot combustion gases to the respective fastening mechanism 214.

The longitudinal axis 270 of the one or more cooling holes 220 may also extend at a circumferential angle (e.g., an angle in a circumferential direction) with respect to the longitudinal axis 272 of a respective fastening mechanism 214. The longitudinal axis 270 of the one or more cooling holes 220 may extend at a circumferential angle between zero and ninety degrees with respect to the longitudinal axis 272 of a respective fastening mechanism 214 to provide an effective curtain of cooling air 223 about the head 216 of a respective fastening mechanism 214 as compared to other or alternative circumferential angles, as detailed above. Accordingly, the one or more cooling holes 220 may extend through the recessed portion 218 to operably direct cooling air 223 about the head 216 of a respective fastening mechanism 214 in a radial or a tangential direction with respect to the longitudinal axis 303 of the fastening mechanism 214, as detailed further below.

The one or more cooling holes 220 may be located about a respective fastening mechanism 214. Accordingly, the one or more cooling holes 220 may operably direct cooling fluid or cooling air 223 from cavity 211 to an area about a head 216 of a respective fastening mechanism 214. Thus, the cooling air 223 may provide a curtain of cool air about a respective fastening mechanism 214, as detailed above. The cooling air 223 may thus reduce the thermal distress on a respective fastening mechanism 214 from the hot combustion gases by providing a cool insulating layer of cooling air 223 about a fastening mechanism 214 to reduce or to prevent heat transfer of the hot combustion gases to the respective fastening mechanism 214. In the example of FIGS. 2A to 2C, the one or more cooling holes 220 include a plurality of cooling holes 220 in a circular pattern about the recessed portion 218. Such a pattern may enable a circular curtain of cooling air 223 about a respective fastening mechanism 214 which generates the cool insulating layer of cooling air 223 about an entire circumference of the head 216 of the respective fastening mechanism 214 for reducing or for preventing heat transfer of the hot combustion gases to an area about the head of the fastening mechanism 214.

In some instances, hot combustion gases (e.g., in the combustion chamber 110) may become entrapped within the curtain of cooling air 223 about the respective fastening mechanism 214. Thus, other embodiments of the panel 200 are provided and detailed below with respect to FIGS. 3A to 3B and 4A to 4B.

The one or more pins 222 extend between a first end and a second end opposite the first end. The one or more pins 222 may be attached or otherwise connected at the first end to the first upstream surface 202 of a respective panel 200 and may be attached or otherwise connected at the second end to a second downstream surface 205 of the annular dome assembly 120. When each panel 200 is mounted or otherwise connected to the annular dome assembly 120, the one or more pins 222 may extend from the first upstream surface 202 of a respective panel 200 to the second downstream surface 205 of the annular dome assembly 120.

The one or more cooling holes 224 may include a longitudinal axis 274 (shown on only one cooling hole 224 in FIG. 2C) that may extend at an angle with respect to a longitudinal axis (co-axial with the longitudinal axis 274 in FIG. 2C) of the one or more pins 222. In FIG. 2C, the one or more cooling holes 224 can extend at an angle of zero degrees with respect to the longitudinal axis of the one or more pins 222. The one or more cooling holes 224 may each extend at an angle between plus or minus ten degrees (±10°) with respect to the longitudinal axis of the one or more pins 222 to provide an effective curtain of cooling air 225 about the head 216 of a respective fastening mechanism 214, as detailed above. In this way, the one or more cooling holes 224 may be angled to direct cooling air 225 radially outward, radially inward, or axially, relative to the head 216, or to the longitudinal axis 272, respectively.

When the one or more pins 222 are mounted between the annular dome assembly 120 and a respective panel 200, the one or more cooling holes 224 may substantially align with respective holes 226 of the annular dome assembly 120 and the holes 228 of the respective panel 200. The holes 226 may extend from a second upstream surface 203 to the second downstream surface 205 of the annular dome assembly 120. The holes 228 may extend from the first upstream surface 202 to the first downstream surface 204. In this way, cooling air 225 from the cavity 136 may flow through the holes 226, through the one or more cooling holes 224, and out of the holes 228. Thus, cooling air 225 through the one or more pins 222 may provide an additional curtain about a respective fastening mechanism 214 to further protect the head 216 from hot combustion gases. The holes 226 and the holes 228 may be angled substantially similarly as the cooling holes 224 through the one or more pins 222. A respective hole 226, a respective cooling hole 224, and a respective hole 228 may together form a single cooling hole for providing a single path through which cooling air 225 may flow.

Figure 3A:
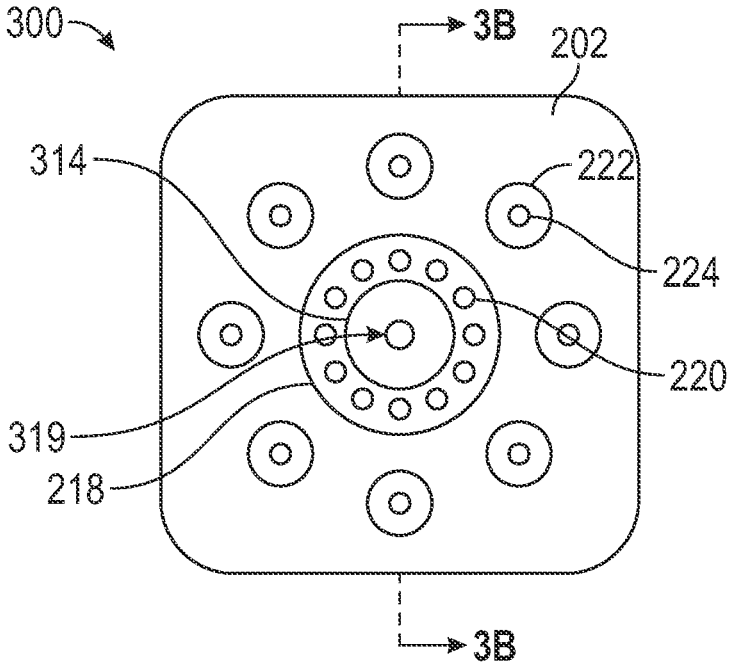
FIG. 3A is an enlarged front view of a portion of another exemplary panel of around an area of a fastening mechanism, according to an aspect of the present disclosure.

FIG. 3A is an enlarged front view of a portion of another exemplary panel 300 around an area of a fastening mechanism 214, according to another embodiment. The panel 200 is substantially the same as the panel 200 and includes many of the same or similar components and functionality. As shown in FIG. 3A, the panel 300 includes a fastening mechanism 314 having one or more cooling holes 319.

Figure 3B:
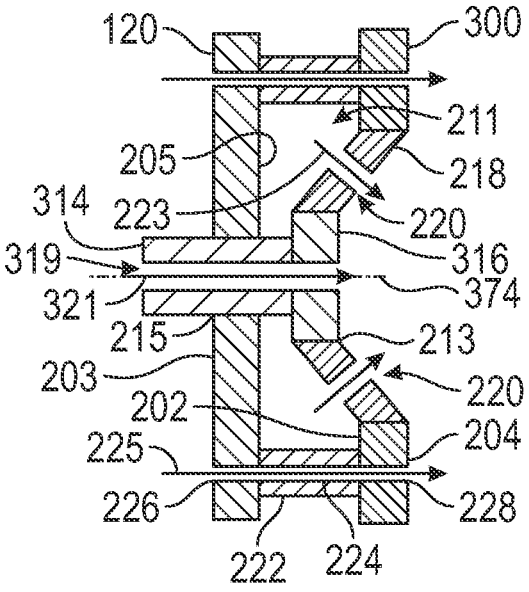
FIG. 3B is a schematic cross-sectional view, taken at detail 3B in FIG. 3A, of a portion of the exemplary panel, according to an aspect of the present disclosure.

FIG. 3B is a schematic cross-sectional view, taken at detail 3B in FIG. 3A, of a portion of the exemplary panel 300. The panel 300 includes one or more fastening mechanisms 314 disposed within the recessed portion 218, similar to the embodiment described in FIGS. 2A to 2C. A respective fastening mechanisms 314 includes one or more cooling holes 319 extending therethrough. The one or more cooling holes 319 extend from an upstream surface of the one or more fastening mechanisms 314 and through a head 316 of the one or more fastening mechanisms 314. The one or more cooling holes 319 may operably direct cooling air 321 from the cavity 136 to a downstream side of the one or more fastening mechanisms 314. The cooling air 321 may reduce or prevent a recirculation bubble of hot combustion air from accumulating about the head 316 of a respective fastening mechanism 314. That is, the one or more cooling holes 319 may operably direct cooling air 321 to flush out or prevent the hot combustion gases from becoming entrapped about the respective fastening mechanism 314.

The one or more cooling holes 319 may each include a longitudinal axis 374. The longitudinal axis 374 of the one or more cooling holes 219 may extend at an axial angle (an angle in an axial direction) with respect to a longitudinal axis (co-axial with the longitudinal axis 374 in FIG. 3) of a respective fastening mechanism 314. The longitudinal axis 374 of the one or more cooling holes 319 may extend at an axial angle between plus or minus ten degrees (±10°) with respect to the longitudinal axis of a respective fastening mechanism 314 to provide an effective angle of cooling air 321 for reducing or preventing a recirculation bubble of hot combustion gases from accumulating about the head 316 of a respective fastening mechanism 314. Preferably, the axial angle at which the one or more cooling holes 319 extends may be zero degrees (0°) to more effectively reduce or prevent a recirculation bubble of hot combustion gases as compared to other axial angles. The longitudinal axis 374 of the one or more cooling holes 319 may also extend at a circumferential angle (e.g., an angle in a circumferential direction) with respect to the longitudinal axis 374 of a respective fastening mechanism 314. The longitudinal axis 374 of the one or more cooling holes 319 may extend at a circumferential angle between zero and ninety degrees with respect to the longitudinal axis of a respective fastening mechanism 314 to effectively reduce or prevent a recirculation bubble of hot combustion gases as compared to other circumferential angles.

Figure 4A:
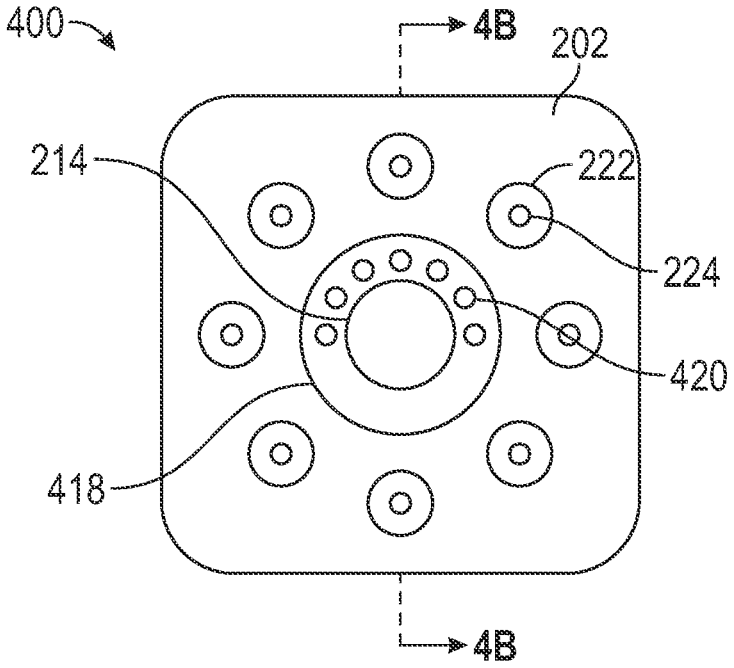
FIG. 4A is an enlarged front view of a portion of another exemplary panel around an area of a fastening mechanism, according to an aspect of the present disclosure.

FIG. 4A is an enlarged front view of a portion of another exemplary panel 400 around an area of a fastening mechanism 214, according to another embodiment. The panel 400 is substantially the same as the panel 200 and includes many of the same or similar components and functionality. As shown in FIG. 4A, the panel 400 includes a recessed portion 418 including cooling holes 420 in a semi-circular pattern about the fastening mechanism 214.

Figure 4B:
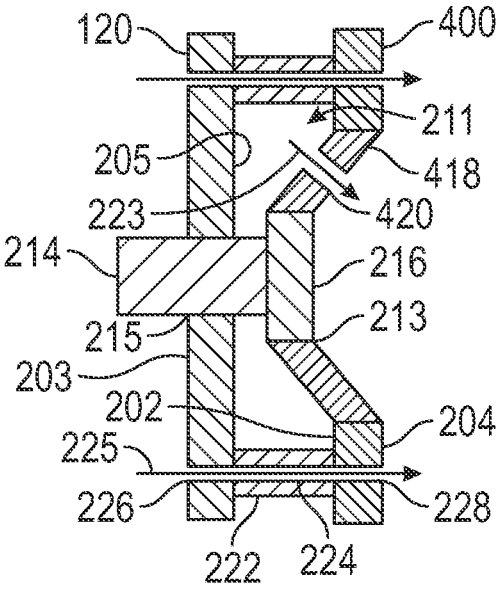
FIG. 4B is a schematic cross-sectional view, taken at detail 4B in FIG. 4A, according to an aspect of the present disclosure.

FIG. 4B is a schematic cross-sectional view, taken at detail 4B in FIG. 4A, of a portion of the exemplary panel 400. The panel 400 includes the recessed portion 418 in an area about the one or more fastening mechanisms 214 and one or more cooling holes 420, similar to the embodiment described in FIGS. 2A to 2C. In the embodiment of FIG. 4B, the one or more cooling holes 420 include a plurality of cooling holes 420 in a semi-circular pattern about only a portion (e.g., a radially outer half) of the recessed portion 418. Such a pattern may enable a semi-circular curtain of cooling air 223 about a respective fastening mechanism 214 while reducing or preventing a recirculation bubble from forming about the head 216 of the respective fastening mechanism 214. That is, the configuration of cooling holes 420 of FIG. 4B may flush out or prevent the hot combustion gases from becoming entrapped about the respective fastening mechanism 214. The one or more cooling holes 420 may be arranged about the fastening mechanism 214 in any pattern, as desired, to reduce or to prevent a recirculation bubble from forming about the head 216 of a respective fastening mechanism 214.

Figure 5:
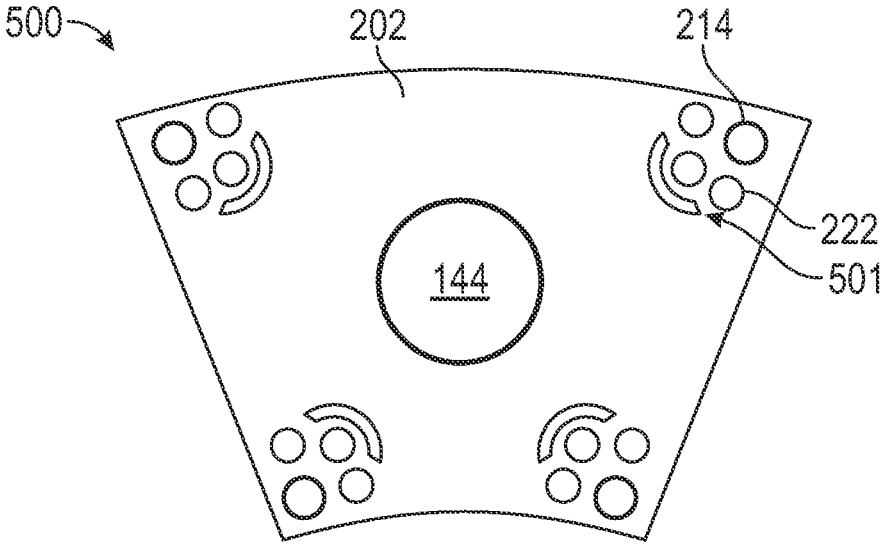
FIG. 5 is a schematic front view of an upstream surface of another exemplary panel, according to an aspect of the present disclosure.

FIG. 5 is a front view of a first upstream surface 202 of another exemplary panel 500, according to an aspect of the present disclosure. The fastening mechanism 214 and the one or more pins 222 are shown schematically in FIG. 5 and only three pins 222 are shown around a circumferential portion of each fastening mechanism 214 for clarity. The one or more pins 222 may include more than three pins 222 arranged in various patterns, as discussed above. Further, while the one or more cooling holes 224 of the one or more pins 222 are not illustrated in FIG. 5, the one or more pins 222 of FIG. 5 may include one or more cooling holes 224, as detailed above.

As shown in FIG. 5, each panel 500 may further include one or more slits 501 (only one of which is labeled in FIG. 5) extending through a respective panel 500. For example, the one or more slits 501 may extend from the first upstream surface 202 to the first downstream surface 204 of a respective panel 500. Each of the one or more slits 501 may be located radially and circumferentially between a respective fastening mechanism 214 and the opening 144 of a respective panel 500. Accordingly, the one or more slits 501 may operably direct additional cooling air from the cavity 136 between the fastening mechanisms 214 and a respective mixer assembly 142 in the opening 144.

As further shown in FIG. 5, the one or more slits 501 may include a generally arcuate shape or a C-shape. The one or more slits 501 may include any size or shape, as necessary, for providing additional cooling air. The size or the shape of the one or more slits 501 may be configured as a function of the distance of a respective fastening mechanism 214 to the opening 144. For example, the one or more slits 501 may include a larger area for fastening mechanisms 214 that are closer to the opening 144 than for fastening mechanisms 214 that are farther away from the opening 144. In some embodiments, the one or more slits 501 may only be associated with fastening mechanisms 214 that are closer to the opening 144. For example, the fastening mechanisms 214 that are farther away from the opening 144 in FIG. 5 (e.g., the fastening mechanisms 214 in the top half of panel 500) may not have one or more slits 501 associated therewith. While one slit 501 is associated with each fastening mechanism 214 in FIG. 5, any number of slits 501 (e.g., a plurality of slits 501) may be associated with, or positioned relative to or proximate to, each fastening mechanism 214. In some embodiments, the slits 501 may be positioned between a respective fastening mechanism 214 and the respective pins 222.

Figure 6A:
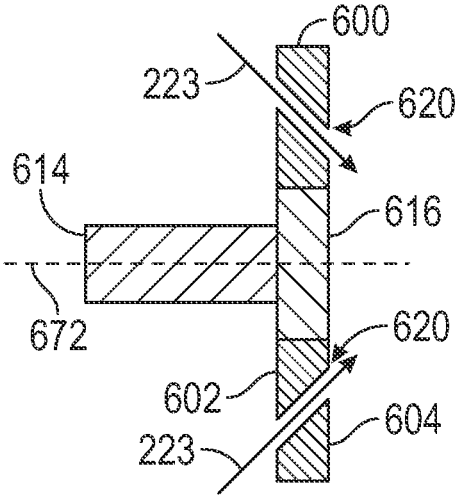
FIG. 6A is a schematic cross-sectional view of a portion of another exemplary panel, according to one embodiment of the present disclosure.
Figure 6B:
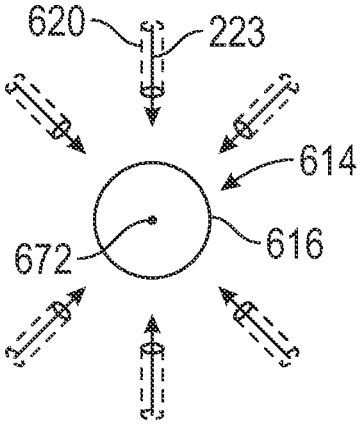
FIG. 6B is a schematic front view of a head of a fastening mechanism and one or more cooling holes of the panel of FIG. 6A, according to an aspect of the present disclosure.

FIG. 6A is a schematic cross-sectional view of another embodiment of a portion of a panel 600 around a fastening mechanism 614, according to another embodiment of the present disclosure. FIG. 6B is a schematic front view of a head 616 of the fastening mechanism 614 and one or more cooling holes 620. While the embodiment of FIGS. 6A and 6B illustrates a fastening mechanism 614 that is not retracted (e.g., the panel 600 does not include a recessed portion), the embodiments described herein may be combined to include a recessed portion such that the fastening mechanism 614 of FIGS. 6A and 6B is retracted (as shown and explained with reference to FIGS. 2B-2C). The panel 600 includes a first upstream surface 602 and a first downstream surface 604. The fastening mechanism 614 includes a head 616 disposed substantially flush with the first downstream surface 604. The fastening mechanism 614 includes a longitudinal axis 672 defined therethrough. The longitudinal axis 672 of the fastening mechanism 614 extends substantially axially when the fastening mechanism 614 is disposed in the panel 600.

The panel 600 includes one or more cooling holes 620. The one or more cooling holes 620 are disposed about the fastening mechanism 614. The one or more cooling holes 620 are angled radially inward with respect to the fastening mechanism 614 to operably direct cooling air 223 radially towards the head 616 of the fastening mechanism 614 (as shown in FIG. 6B), similar to the embodiment of FIGS. 2A-2C. In this way, the one or more cooling holes 620 may operably direct cooling flow about the head 616 of the fastening mechanism 614, as detailed above.

Figure 7:
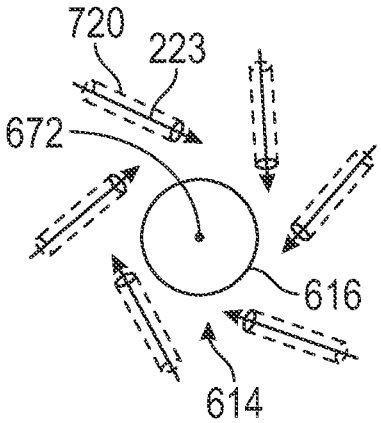
FIG. 7 is a schematic front view of a head of a fastening mechanism and another embodiment of one or more cooling holes of a panel, according to an aspect of the present disclosure.

FIG. 7 is a schematic front view of a head 616 of the fastening mechanism 614 and one or more cooling holes 720, according to another embodiment. The cooling holes 720 are also angled circumferentially to operably direct cooling air 623 tangentially to the head 616 of the fastening mechanism 614. For example, the one or more cooling holes 720 extend at a circumferential angle (e.g., an angle in a circumferential direction) with respect to the longitudinal axis 672 of the fastening mechanism 614. In this way, the cooling holes 720 supply cooling air 223 tangentially to the head 616 of the fastening mechanism 614.

Figure 8:
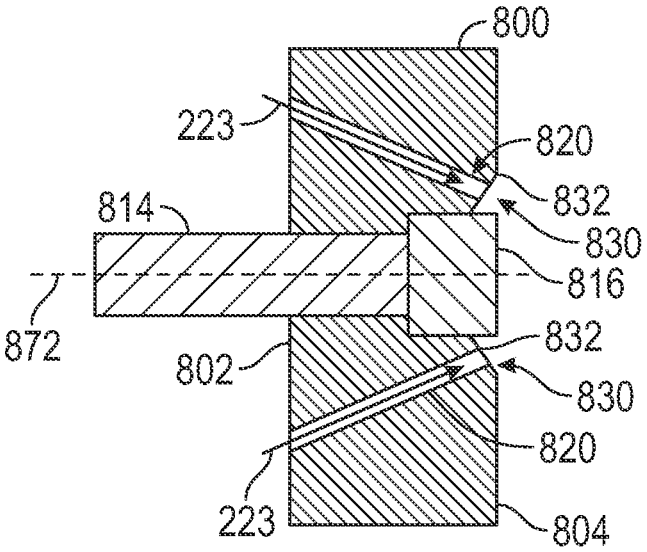
FIG. 8 is a schematic cross-sectional view of a portion of another exemplary panel about a fastening mechanism, according to an aspect of the present disclosure.

FIG. 8 is a schematic cross-sectional view of another embodiment of a portion of a panel 800 about a fastening mechanism 814, according to another embodiment of the present disclosure. While the embodiment of FIG. 8 illustrates a fastening mechanism 814 that is not retracted (e.g., the panel 800 does not include a recessed portion, the embodiments described herein may be combined to include a recessed portion such that the fastening mechanism 814 of FIG. 8 is retracted (as shown and explained with reference to FIGS. 2B to 2C). The panel 800 includes a first upstream surface 802 and a first downstream surface 804. The fastening mechanism 814 includes a head 816 disposed substantially flush with the first downstream surface 804. The fastening mechanism 814 includes a longitudinal axis 872 defined therethrough. The longitudinal axis 872 of the fastening mechanism 814 extends substantially axially when the fastening mechanism 814 is disposed in the panel 800.

The panel 800 includes one or more cooling holes 820. The one or more cooling holes 820 are disposed about the fastening mechanism 814. The one or more cooling holes 820 are angled radially inward with respect to the fastening mechanism 814 to operably direct cooling air 223 radially towards the head 816 of the fastening mechanism 814, similar to the embodiment of FIGS. 2A-2C. In this way, the one or more cooling holes 820 may operably direct cooling flow about the head 816 of the fastening mechanism 814, as detailed above. As shown in FIG. 8, the cooling holes 820 may further include a groove 830 for providing or otherwise generating vortices about the fastening mechanism 814. The groove 830 may include an inward face 832 extending at an angle from first downstream surface 804. The inward face 832 may extend at any angle between zero degrees (0°) and sixty degrees (60°) with respect to the first downstream surface 804 for generating vortices about the fastening mechanism 814. In this way, the groove 830 may further direct the cooling air 823 towards head 816 of the fastening mechanism 814, or at least toward a portion of the head 816 not flush with the inward face 832, to provide additional heat transfer protection and heat dissipation about the fastening mechanism 814. The groove 830 may include any size or any shape for generating vortices and promoting cooling air 223 to flow towards the head 816 of the fastening mechanism 814.

Figure 9:
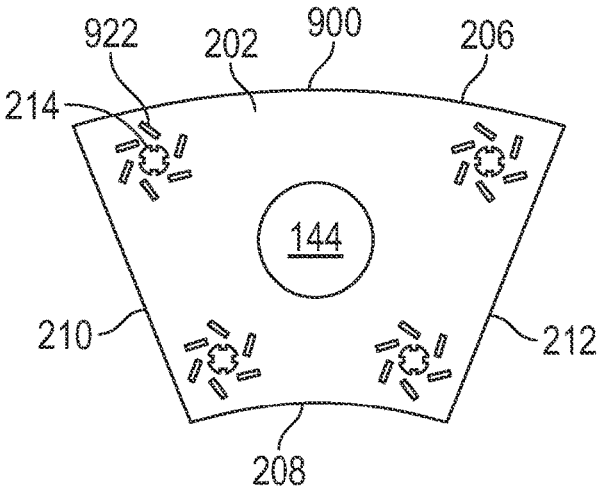
FIG. 9 is a schematic front view of an upstream surface of another embodiment of a panel including one or more pins, according to an aspect of the present disclosure.

FIG. 9 is a front view of the first upstream surface 202 of another embodiment of a panel 900 including one or more pins 922, according to aspects of the present disclosure. The one or more pins 922 may include an elongate shape such that the first end and the second end of each of the one or more pins 922 is elongate. The elongate shape of the one or more pins 922 may provide a greater surface area at the first end and the second end as compared to the generally cylindrical shape of the one or more pins 222 of FIGS. 2A-2C, described above. In FIG. 9, the one or more pins 922 may include an elongated, rectangular shape and each pin 922 may be positioned tangentially with respect to the fastening mechanism 214.

Figure 10:
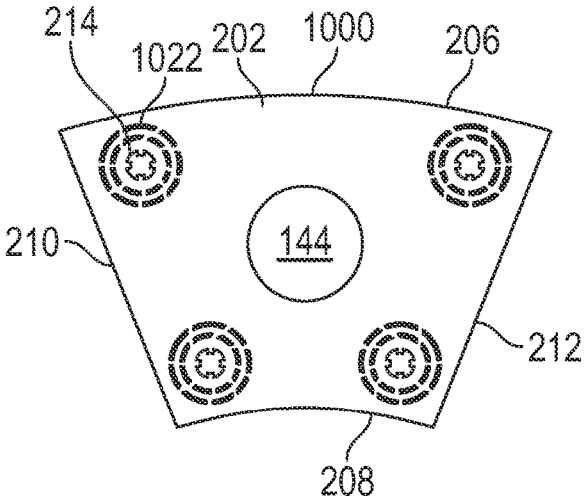
FIG. 10 is a schematic front view of an upstream surface of another exemplary panel including one or more pins, according to an aspect of the present disclosure.

FIG. 10 is a front view of the first upstream surface 202 of another embodiment of a panel 1000 including one or more pins 1022, according to aspects of the present disclosure. In FIG. 10, the one or more pins 1022 may include various generally arc shapes and may be positioned in a circular pattern about each respective fastening mechanism 214.

Figure 11:
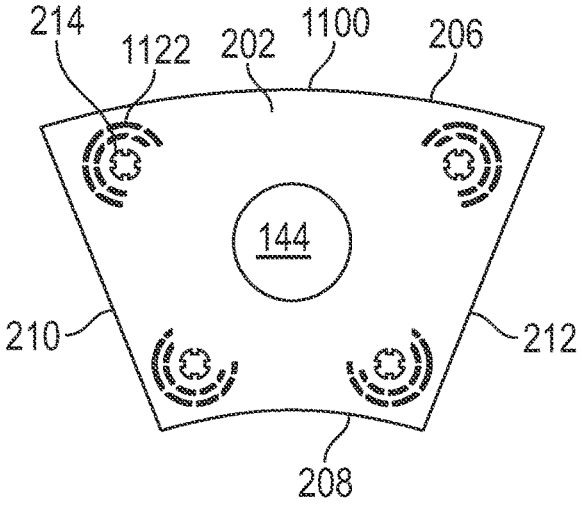
FIG. 11 is a schematic front view of an upstream surface of another exemplary panel including one or more pins, according to an aspect of the present disclosure.

FIG. 11 is a front view of the first upstream surface 202 of another embodiment of a panel 1100 including one or more pins 1122, according to aspects of the present disclosure. In FIG. 11, the one or more pins 1122 may include various generally arc shapes and may be positioned in a semi-circular pattern about each respective fastening mechanism 214. The semi-circular pattern of the one or more pins 1122 may be located on a side of the fastening mechanism 214 away from the opening 144. For example, the semi-circular pattern may be located between a respective fastening mechanism 214 and the circumferential outer side 206, the circumferential inner side 208, the first radially extending side 210, or the second radially extending side 212, respectively.

Figure 12:
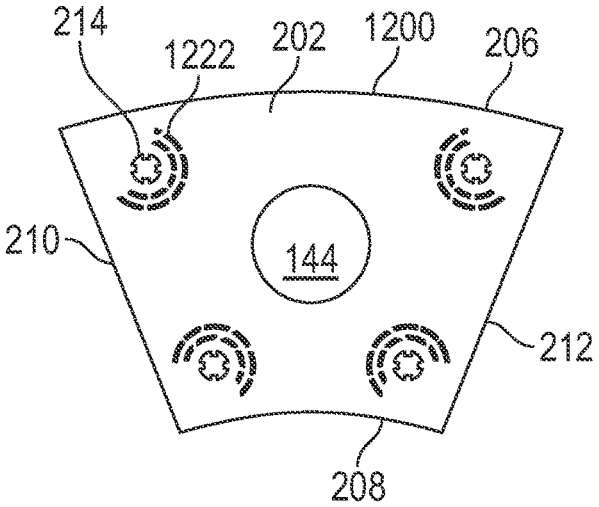
FIG. 12 is a schematic front view of an upstream surface of another exemplary panel including one or more pins, according to an aspect of the present disclosure.

FIG. 12 is a front view of the first upstream surface 202 of another embodiment of a panel 1200 including one or more pins 1222, according to aspects of the present disclosure. In FIG. 12, the semi-circular pattern of the one or more pins 1222 may be located on a side of the fastening mechanism 214 closer to the opening 144. For example, the semi-circular pattern of the one or more pins 1222 may be located substantially between the fastening mechanism 214 and the opening 144. In FIGS. 10 to 12, the one or more pins 222 may each include an elongate portion extended between a first end and a second end. The first end and the second end may be inclined such that the ends of the one or more pins 222 extend at an angle with respect the elongate portion of the one or more pins 222. For example, the first end and the second end may not be perpendicular with the elongate portion. The first end and the second end being inclined may facilitate air swirl between respective pins 222 to provide additional cooling in an area about the one or more pins 222.

The embodiments of the pins 922, 1022, 1122, 1222 of FIGS. 9 to 12 may each provide for increased surface area or increased generation of turbulence to enable increased heat transfer and heat dissipation in the area on a panel about the one or more pins as compared to deflector assemblies without the benefit of the present disclosure. As detailed above, the pins 922, 1022, 1122, 1222 may include any size or shape and may be arranged in any pattern about a respective fastening mechanism 214, as desired, for providing improved heat transfer and heat dissipation.

Further aspects of the present disclosure are provided by the subject matter of the following clauses.

A deflector assembly for a combustor. The deflector assembly includes an upstream surface and a downstream surface opposite the upstream surface. One or more fastening mechanisms each extend through the deflector assembly. One or more cooling holes extend through the deflector assembly from the upstream surface to the downstream surface. The one or more cooling holes located about the one or more fastening mechanisms to operably direct cooling air about the one or more fastening mechanisms at the downstream surface.

The deflector assembly of any preceding clause, the one or more cooling holes being positioned in a circular pattern around each of the one or more recessed portions.

The deflector assembly of any preceding clause, the one or more cooling holes being positioned in a semi-circular pattern around each of the one or more recessed portions.

The deflector assembly of any preceding clause, the one or more cooling holes being angled radially with respect to the one or more fastening mechanisms to operably direct cooling air radially about the one or more fastening mechanisms at the downstream surface.

The deflector assembly of any preceding clause, the one or more cooling holes being angled circumferentially with respect to the one or more fastening mechanisms to operably direct cooling air tangentially about the one or more fastening mechanisms at the downstream surface.

The deflector assembly of any preceding clause, the one or more cooling holes including a groove configured to generate vortices of cooling air in an area around the one or more fastening mechanisms at the downstream surface.

The deflector assembly of any preceding clause, the one or more cooling holes being first cooling holes, the one or more fastening mechanisms including one or more second cooling holes extending through the one or more fastening mechanisms to operably direct cooling air through the one or more fastening mechanisms at the downstream surface of the deflector assembly.

The deflector assembly of any preceding clause, further including one or more slits positioned between the one or more fastening mechanisms and a central opening of the deflector assembly to provide cooling air through the one or more slits at the downstream surface.

The deflector assembly of any preceding clause, further including one or more recessed portions receding from the downstream surface. The one or more fastening mechanisms extend from the one or more recessed portions such that the one or more fastening mechanisms are retracted with respect to the downstream surface.

The deflector assembly of any preceding clause, the one or more recessed portions receding at an angle greater than zero degrees and less than or equal to ninety degrees from the downstream surface.

The deflector assembly of any preceding clause, the one or more first cooling holes extending through the one or more recessed portions.

The deflector assembly of any preceding clause, further including one or more pins extending from the upstream surface of the deflector assembly, the one or more pins being positioned about the one or more fastening mechanisms.

The deflector assembly of any preceding clause, each of the one or more pins including one or more third cooling holes therethrough to provide cooling air around the one or more fastening mechanisms at the downstream surface.

The deflector assembly of any preceding clause, the one or more pins including an elongate surface connected to the upstream surface of the one or more panels.

The deflector assembly of any preceding clause, the one or more pins being positioned tangentially with respect to the one or more fastening mechanisms.

The deflector assembly of any preceding clause, the one or more pins being positioned in a circular pattern about each of the one or more fastening mechanisms.

The deflector assembly of any preceding clause, the one or more pins being positioned in a semi-circular pattern about each of the one or more fastening mechanisms.

A method of operably flowing cooling air through a deflector assembly of a combustor. The method including flowing the cooling air through one or more cooling holes from an upstream surface of the deflector assembly to a downstream surface of the deflector assembly. The method further including causing the cooling air to exit the one or more cooling holes at the downstream surface about one or more fastening mechanisms of the deflector assembly.

The method of the preceding clause, further including causing the cooling air to exit the one or more cooling holes in a circular pattern about the one or more fastening mechanisms.

The method of any preceding clause, further including causing the cooling air to exit the one or more cooling holes in a semi-circular pattern about the one or more fastening mechanisms.

The method of any preceding clause, further including flowing the cooling air through the one or more cooling holes radially with respect to the one or more fastening mechanisms, and causing the cooling air to exit the one or more cooling holes radially about the one or more fastening mechanisms at the downstream surface.

The method of any preceding clause, further including flowing the cooling air through the one or more cooling holes circumferentially with respect to the one or more fastening mechanisms, and causing the cooling air to exit the one or more cooling holes tangentially about the one or more fastening mechanisms at the downstream surface.

The method of any preceding clause, further including generating vortices of cooling air by a groove in the one or more cooling holes in an area about the one or more fastening mechanisms at the downstream surface.

The method of any preceding clause, the one or more cooling holes being first cooling holes, the method further including flowing cooling air through one or more second cooling holes that extend through the one or more fastening mechanisms, and causing the cooling air to exit the one or more second cooling holes through the one or more fastening mechanisms at the downstream surface.

The method of any preceding clause, further including flowing cooling air through one or more slits of the deflector assembly at the downstream surface, the one or more slits being located between the one or more fastening mechanisms and a central opening of the deflector assembly.

The method of any preceding clause, the one or more first cooling holes extending through a recessed portion of the deflector assembly, the recessed portion receding from the downstream surface, the one or more fastening mechanisms extending from the recessed portion such that the one or more fastening mechanisms are retracted with respect to the downstream surface.

The method of any preceding clause, further including flowing cooling air through one or more third cooling holes of one or more pins of the deflector assembly, the one or more pins being positioned about the one or more fastening mechanisms.

Although the foregoing description is directed to the preferred embodiments, other variations and modifications will be apparent to those skilled in the art, and may be made without departing from the spirit or the scope of the disclosure. Moreover, features described in connection with one embodiment may be used in conjunction with other embodiments, even if not explicitly stated above.

What is claimed is:

1. A deflector assembly for a combustor defining an operational fluid flow, the deflector assembly comprising:

an upstream surface and a downstream surface opposite the upstream surface in an axial direction of the combustor;

one or more fastening mechanisms each extending through the deflector assembly; and one or more cooling holes extending through the deflector assembly from the upstream surface to the downstream surface, the one or more cooling holes located about the one or more fastening mechanisms and angled radially with respect to the one or more fastening mechanisms to operably direct cooling air radially about the one or more fastening mechanisms at the downstream surface, the one or more cooling holes including a first cooling hole positioned on a first radial side of the one or more fastening mechanisms and a second cooling hole positioned on a second radial side equidistant from the one or more fastening mechanisms and opposite the first radial side, the first cooling hole operably directing the cooling air with a first radial vector in a first radial direction towards the one or more fastening mechanisms and the second cooling hole operably directing the cooling air with a second radial vector in a second radial direction towards the one or more fastening mechanisms.

2. The deflector assembly of claim 1, wherein the one or more cooling holes include a plurality of cooling holes that are positioned in a circular pattern about the one or more fastening mechanisms.

3. The deflector assembly of claim 1, wherein the one or more cooling holes include a plurality of cooling holes that are positioned in a semi-circular pattern about the one or more fastening mechanisms.

4. The deflector assembly of claim 1, wherein the one or more cooling holes are angled circumferentially with respect to the one or more fastening mechanisms to operably direct cooling air tangentially about the one or more fastening mechanisms at the downstream surface.

5. The deflector assembly of claim 1, wherein the one or more cooling holes include a groove configured to generate vortices of cooling air in an area about the one or more fastening mechanisms at the downstream surface.

6. The deflector assembly of claim 1, further comprising one or more pins extending from the upstream surface of the deflector assembly, the one or more pins being positioned about the one or more fastening mechanisms.

7. The deflector assembly of claim 6, wherein each of the one or more pins includes one or more third cooling holes therethrough to provide cooling air about the one or more fastening mechanisms at the downstream surface.

8. The deflector assembly of claim 6, wherein the one or more pins include an elongate surface connected to the upstream surface of the deflector assembly.

9. The deflector assembly of claim 8, wherein the one or more pins are positioned tangentially with respect to the one or more fastening mechanisms.

10. The deflector assembly of claim 6, wherein the one or more pins are positioned in a circular pattern about each of the one or more fastening mechanisms.

11. The deflector assembly of claim 6, wherein the one or more pins are positioned in a semi-circular pattern about each of the one or more fastening mechanisms.

12. The deflector assembly of claim 1, further comprising:

an annular dome assembly; and a panel coupled to the annular dome assembly with the one or more fastening mechanisms, wherein the one or more cooling holes extend only through the panel.

13. The deflector assembly of claim 12, wherein the one or more cooling holes comprise a plurality of cooling holes and the one or more fastening mechanism comprise a plurality of fastening mechanism, and a subset of cooling holes of the plurality of cooling holes are angled radially inward toward each fastening mechanism of the plurality of fastening mechanism.

14. The deflector assembly of claim 13, wherein each subset of cooling holes is angled circumferentially about the respective fastening mechanism.

15. The deflector assembly of claim 1, further comprising one or more slits positioned between the one or more fastening mechanisms and a central opening of the deflector assembly to operably direct cooling air through the one or more slits at the downstream surface.

16. A deflector assembly for a combustor defining an operational fluid flow, the deflector assembly comprising:

an upstream surface and a downstream surface opposite the upstream surface in an axial direction;

a central opening extending through the deflector assembly;

one or more fastening mechanisms each extending through the deflector assembly;

one or more cooling holes extending through the deflector assembly from the upstream surface to the downstream surface, the one or more cooling holes located about the one or more fastening mechanisms to operably direct cooling air about the one or more fastening mechanisms at the downstream surface; and one or more slits positioned between the one or more fastening mechanisms and the central opening of the deflector assembly to operably direct cooling air through the one or more slits at the downstream surface.

17. The deflector assembly of claim 16, further comprising one or more pins extending from the upstream surface of the deflector assembly, the one or more pins being positioned between the one or more fastening mechanisms and the one or more slits.

18. A method of operably flowing cooling air through a deflector assembly of a combustor, the deflector assembly including one or more fastening mechanisms and one or more cooling holes extending through the deflector assembly from an upstream surface of the deflector assembly to a downstream surface of the deflector assembly in an axial direction, the one or more cooling holes being located about the one or more fastening mechanisms and angled radially with respect to the one or more fastening mechanisms, the method comprising:

flowing the cooling air through a first cooling hole of the one or more cooling holes with a first radial vector in a first radial direction towards the one or more fastening mechanisms, the first cooling hole being positioned on a first radial side of the one or more fastening mechanisms;

flowing the cooling air through a second cooling hole of the one or more cooling holes with a second radial vector in a second radial direction towards the one or more fastening mechanisms, the second cooling hole being positioned on a second radial side equidistant from the one or more fastening mechanisms and opposite the first radial side; and causing the cooling air to exit the one or more cooling holes at the downstream surface about the one or more fastening mechanisms.

19. The method of claim 18, wherein the one or more cooling holes include a plurality of cooling holes, and causing the cooling air to exit the one or more cooling holes includes causing the cooling air to exit the plurality of cooling holes in a circular pattern about the one or more fastening mechanisms.

20. The method of claim 18, wherein the one or more cooling holes include a plurality of cooling holes, and causing the cooling air to exit the one or more cooling holes includes causing the cooling air to exit the plurality of cooling holes in a semi-circular pattern about the one or more fastening mechanisms.

* * * * *